United States Patent [19]

Magyar

[11] Patent Number: 4,613,446

[45] Date of Patent: Sep. 23, 1986

[54] GELLED DETERGENT COMPOSITION AND CLEANING PADS CONTAINING SAME

[75] Inventor: Arpad M. Magyar, Conroe, Tex.

[73] Assignee: Pennzoil Company, Houston, Tex.

[21] Appl. No.: 711,151

[22] Filed: Mar. 13, 1985

[51] Int. Cl.[4] ..... C11D 9/14; B08B 1/00

[52] U.S. Cl. ..... 252/91; 252/92; 252/109; 252/110; 252/DIG. 14; 252/527; 252/134; 252/111; 15/104.93

[58] Field of Search ..... 252/108, 109, 110, 91, 252/92, DIG. 14, 527, 134, 111; 15/104.93

[56] References Cited

U.S. PATENT DOCUMENTS

| | | | |
|---|---|---|---|
| 2,026,638 | 1/1936 | Kingman | 15/104.93 |
| 2,483,135 | 9/1949 | Goldsmith et al. | 252/109 |
| 3,203,900 | 8/1965 | Carroll et al. | 252/110 |
| 3,337,465 | 8/1967 | Lancz et al. | 252/91 |
| 3,360,476 | 12/1967 | Krusius | 252/107 |
| 3,794,589 | 2/1974 | Fishman | 252/110 |
| 3,949,137 | 4/1976 | Akrongold et al. | 428/311 |
| 4,064,063 | 12/1977 | Alder et al. | 252/135 |
| 4,170,565 | 10/1979 | Flesher et al. | 252/93 |
| 4,310,432 | 1/1982 | Brouwer | 252/108 |
| 4,372,867 | 2/1983 | Taragos | 252/91 |
| 4,377,489 | 3/1983 | King | 252/99 |
| 4,390,465 | 6/1983 | Spekman, Jr. | 252/527 |
| 4,448,704 | 5/1984 | Barby et al. | 252/91 |

FOREIGN PATENT DOCUMENTS

| | | |
|---|---|---|
| 263144 | 2/1964 | Australia . |
| 621615 | 6/1961 | Canada . |
| 650083 | 10/1962 | Canada . |
| 2447945 | 4/1975 | Fed. Rep. of Germany . |
| 640373 | 7/1950 | United Kingdom . |
| 988235 | 4/1965 | United Kingdom . |

OTHER PUBLICATIONS

McCutcheon's, "Detergents & Emulsifiers," North American ed., 1982, MC Publishing Co., N.J., p. 244.

*Primary Examiner*—Prince E. Willis

*Attorney, Agent, or Firm*—Lowe, Price, Leblanc, Becker & Shur

[57] ABSTRACT

Gelled detergent compositions are contained in cleaning devices such as plastic mesh pads and sponges, which gelled detergent compositions comprise water, an alkali metal hydroxide, an alkali metal phosphate, a wetting agent, a fatty acid which reacts with the alkali metal hydroxide to form a soap, a chelating agent, a surfactant, and optionally colorant and odorant components.

14 Claims, 2 Drawing Figures

GELLED DETERGENT COMPOSITION AND CLEANING PADS CONTAINING SAME

FIELD OF THE INVENTION

This invention relates to substrates, such as plastic mesh pads and sponges, and to detergent compositions incorporated therein, which detergent impregnated sponges and pads are designed to be used as large size scouring pieces for cleaning whitewall tires, vinyl tops and trims, bumpers and other surfaces. The formulation used in the pads and sponges contains a balanced high activity liquid detergent composition which, through the action of a fatty acid precursor, congeals into a soft, soapy consistency upon being cooled to ambient temperature.

BACKGROUND

Much effort has been made in recent years to develop cleaning compositions which, by application to automobile, bus, or truck surfaces, would effectively remove road film from these vehicles. The road film is a diverse mixture of dirt, fuel and lubricant residues, soot and other materials which settle on the vehicle from the air or are picked up from roads; it resists the cleaning action of many detergent compositions. Because the detergent composition must not deteriorate the paint surface on the trucks and automobiles or corrode exposed metal components thereof, the highly alkaline or acidic detergent compositions normally used to remove greases and the like from metal parts cannot be safely used.

Various soap-impregnated pads and sponges are known in the art. For example, U.S. Pat. No. 3,949,137 to Akrongold et al discloses a gel-impregnated sponge. The gel materials used in that invention are conventional and form no part of the present invention (column 3, lines 8–12). U.S. Pat. No. 4,448,704 to Barby et al describes articles suitable for wiping surfaces such as sponges or pads. The liquid cleaning composition applied to the substrate there comprises lower aliphatic water-miscible alcohols, nonionic or anionic surfactants and partially esterified resins. U.S. Pat. No. 4,170,565 to Flesher discloses an article useful in a process for cleaning fabrics utilizing a water-insoluble substrate. Preferred water-soluble surface-active agents for use in the articles of that invention include those selected from the group consisting of anionic surfactants, nonionic surfactants, zwitterionic surfactants, and mixtures thereof. These water-soluble surfactants include any of the common anionic, nonionic and zwitterionic detersive surfactants well known in the detergency arts (column 7, lines 61–64). U.S. Pat. No. 4,372,867 to Taragos discloses an upholstery cleaning pad impregnated with sodium lauryl sulfate, a glazing agent, a bleaching agent and degreasers.

Various compositions similar to the composition of the present invention are also known in the art. Fishman U.S. Pat. No. 3,794,589 discloses a detergent composition containing sodium alkyl sulfate, Triton X-100, sodium tripolyphosphate, and a fatty acid soap. U.S. Pat. No. 4,064,063 to Alder discloses a detergent composition containing sodium hydroxide, fatty acid, sodium ethylenediamine tetraacetic acid, sodium tripolyphosphate, a base, and water. U.S. Pat. No. 4,390,465 to Spekman discloses a detergent composition containing sodium hydroxide, sodium tripolyphosphate, tetrasodiumethylenediaminetetraacetate and hexylene glycol. Finally, Canadian Pat. No. 650,083 discloses detergent compositions with sodium hydroxide, a water soluble condensed phosphate and an organic calcium-sequestering agent containing the amino-diacetic acid group.

As noted above, however, no simple, highly effective and safe detergent composition has been found yet which completely satisfies the needs of the industry.

SUMMARY OF THE INVENTION

It is an object of the present invention to provide an improved substrate, and in particular an improved mesh pad, saturated with a special improved detergent composition designed to clean dirt and grime from whitewall tires and other surfaces.

It is a further object of this invention to provide a method for preparing the improved pad and composition.

It is an even further object of this invention to provide an improved detergent composition suitable for removing dirt and grime from whitewall tires, vinyl tops and automotive surfaces.

A still further object of this invention is to provide a method for removing dirt and grime from whitewall tires; vinyl tops, automobile surfaces and other surfaces by application of the improved, detergent composition in a saturated pad.

Other objects and advantages of the invention will become apparent as the description thereof proceeds.

In satisfaction of the foregoing objects, the present invention provides a sponge, pad or other suitable substrate carrying a special detergent formulation comprising deionized water, sodium hydroxide or some equivalent compound reacting with the fatty acid of the composition to form a soap or detergent, a filler, water softener and alkaline-type buffer material which may also provide detergent activity, a wetting agent, a chelating agent, a suitable surfactant which can serve as an emulsifier, and optionally a colorant, dye or optical brightener and an odorant. The resulting product can be applied to dirty, grimy surfaces such as whitewall tires, vinyl tops and trims, bumpers and other equivalent surfaces to provide effective cleaning.

The formulation and product are prepared by first dissolving all the components except the detergent and surfactant and, if used, the dye and odorant, into water. The temperature is then raised while a suitable detergent, such as a fatty acid soap, is added. When the detergent is totally dissolved, the surfactant, and optional odorants and dyes are added, and a hot solution is formed. The substrate, such as a pad, sponge, or the like, is dipped into the hot solution and the solution is allowed to gel at lowered temperatures.

BRIEF DESCRIPTION OF THE DRAWINGS

Reference is now made to the drawings accompanying the application wherein.

DESCRIPTION OF PREFERRED EMBODIMENTS

Figure 1:
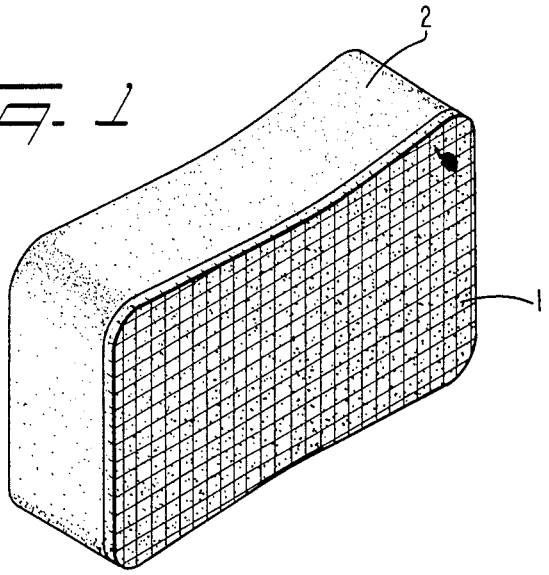
FIG. 1 is a perspective view of a first embodiment of the invention.

The present invention provides a novel detergent composition and cleaning product wherein the detergent composition comprises water, preferably deionized water, an alkali metal polyphosphate which serves as a filler, water softener, alkaline buffer and detergent, a wetting agent for lifting dirt, a soap or detergent for cleaning, a chelating agent, a surfactant which can also serve as an emulsifier, a colorant, dye or optical brightener and an odorant or perfume. The composition is applied to a substrate to form a cleaning product to clean dirty, grimy surfaces such as those found on automobiles, although it is to be understood that their use is not limited to this aspect.

The cleaning composition of the present invention may be broadly described by the following formulation:

| Component | Wt. % |
|---|---|
| Water | 50–60 |
| Alkali metal hydroxide (40–60%) | 2–10 |
| Alkali metal phosphate | 1–10 |
| Wetting agent | 5–20 |
| Fatty Acid | 10–20 |
| Chelating agent | 0.1–5 |
| Surfactant | 5–20 |
| Colorant | 0–0.5 |
| Odorant | 0–1.0 |

The resulting composition is very mild and lightly corrosive. It has a pH of about 7.5 to 8.5 and thus is not injurious to the hands.

The alkaline metal component of the composition is any alkali metal hydroxide, such as sodium or potassium hydroxide, or any equivalent thereof which is capable of reacting with a fatty acid to form a soap (i.e., the salt of a fatty acid) in order to form a gel. Any straight-chain fatty acid having from 3–20 carbons may be used, although those having 12–20 carbons are preferred. The soap in the composition is thus formed by the reaction of alkali hydroxide and a fatty acid. Depending on the particular fatty acid or alkali metal hydroxide used, various soaps may be formed. The alkali metal hydroxide solution used in the invention is preferably a water solution having a concentration of from 40–60 weight percent alkali metal hydroxide and represents from 2–10 weight percent, preferably about 4–6 weight percent, of the entire composition used.

The water is preferably deionized water and represents about 50–60 weight percent, preferably about 53–58 weight percent, of the composition. The hydroxide ions are important for neutralizing any acidic component as when ethylenediaminetetraacetic acid is used as a chelating agent in the composition.

The composition also contains from 1–10 weight percent of an alkali metal polyphosphate and preferably about 2–5 weight percent. This alkali metal polyphosphate serves as a filler, as a water softener in combination with a chelating agent such as ethylenediaminetetraacetic acid, and as an alkaline type buffering material. It also serves as a detergent because of its dirt dispersal qualities. Examples of compounds which may be used include but are not limited to tetrasodium pyrophosphate, trisodium pyrophosphate, trisodium phosphate, sodium tripolyphosphate and potassium tripolyphosphate, and mixtures thereof.

An important component of the composition is a wetting agent which acts to lift dirt from the material. The wetting agent is present in an amount of from 5–20 weight percent, preferably about 8–15 weight percent, of the composition. Typical examples of wetting agents which can be used for the composition are sulfate wetting agents as sodium 2-ethylhexyl sulfate, Emersal TM or any other substance which increases the penetration of the composition onto the surface to be cleaned.

A fourth component used in the composition is any fatty acid which, upon reaction with the alkali metal hydroxide, will form a soap or detergent which provides cleaning action and establishes the gel structure of the formulation. Fatty acids having 12–20 carbon atoms are preferred and are present in amounts of from 10–20 weight percent, preferably about 15 weight percent of the composition. As noted above, various soaps may be formed depending on the particular fatty acid and alkali metal hydroxide which is used.

A fifth component of the composition is from 0.1–5 weight percent, preferably about 0.50 weight percent, of a chelating agent which will react with the alkali metal of the alkali metal hydroxide to make the sodium form and become water soluble. Equivalent chelating agents may be used.

Also present in the composition is from 5–20 weight percent surfactants, preferably about 10 weight percent. Although in principle any anionic, nonionic, cationic, zwitterionic or amphoteric surface-active agent may be used, nonionic surface-active agents, which tend to be high-foaming, are especially preferred. In general, nonionic surface-active agents consist of a hydrophobic moiety, such as $C_8$–$C_{20}$ primary or secondary, branched or straight chain monoalcohols, $C_8$–$C_{18}$ mono- or dialkyphenols, $C_8$–$C_{20}$ fatty acid amides, and a hydrophilic moiety which consists of alkylene oxide units. These nonionic surface-active agents are for instance alkoxylation products of the above hydrophobic moieties, containing from 2 to 30 moles of alkylene oxide. As alkylene oxides ethylene-, propylene- and butylene oxides and mixtures thereof are used.

Typical examples of such nonionic surfactants are $C_9$–$C_{11}$ primary, straight-chain alcohols condensed with from 5–9 moles of ethylene oxide, $C_{12}$–$C_{15}$ primary straight-chain alcohols condensed with from 6–12 moles of ethylene oxide, or with 7–9 moles of a mixture of ethylene oxide, $C_{11}$–$C_{15}$ secondary alcohols condensed with from 3–15 moles of ethylene oxide, and $C_{10}$–$C_{18}$ fatty acid diethanolamides. Tertiary amine oxides such as higher alkyl di(lower alkyl or lower substituted alkyl)amine oxides, are also suitable nonionic surfactants for use in the article of the invention. Further examples may be found in N. Shick's textbook "Nonionic Surfactants", M. Dekker Inc., New York, 1967. Mixtures of various nonionic surfactants may also be used.

Optionally, a deodorant and/or coloring agent may be present in the composition. The deodorant is preferably an industrial odorant or perfume. The preferred deodorant used in the present invention is pine oil to provide a pine scent. The odorant should be present in an amount from 0.01 to 0.10, preferably 0.1–0.5, weight percent for best results. Further, a water soluble coloring agent may also be present. The agent may be a dye, preferably green or blue dye, or an optical brightener. The preferred dye of the present invention is a blue water soluble dye. The dye or optical brightener may be present in the composition in an amount from 0.0 to 0.5 weight percent, preferably, 0.01–0.2 weight percent.

The preferred formulation of the invention is as follows:

| Component | Wt. % |
|---|---|
| Deionized Water | 50–60 |

-continued

| Component | Wt. % |
|---|---|
| Alkali metal hydroxide (40-60%) | 2-5 |
| Alkali metal polyphosphate | 2-5 |
| Wetting agent | 8-15 |
| Fatty Acid | 12-18 |
| Chelating agent | 0.2-1.0 |
| Surfactant | 8-15 |
| Colorant/Optical Brightener | 0-0.5 |
| Odorant/Perfume | 0-1.0 |

In a further embodiment of the invention, a method is provided for preparing the detergent solution and impregnating the preferred substrate.

According to this aspect of the invention, the alkali metal hydroxide solution, alkali polyphosphate, the chelating agent and sulfate wetting agent are dissolved in water. The temperature is then brought to a temperature of about 150°-170° F. and the fatty acid is slowly added with good agitation. The temperature is then raised to 190°-210° F. During this process the alkali metal hydroxide reacts with the fatty acid to form a soap and gel and also neutralizes the chelating agent. After all of the fatty acid is dissolved in the blend, the surfactant, odorant and dye or brightener are added. Plastic mesh pads are then dipped into the hot detergent solution and allowed to gel at ambient or below ambient temperatures.

Figure 2:
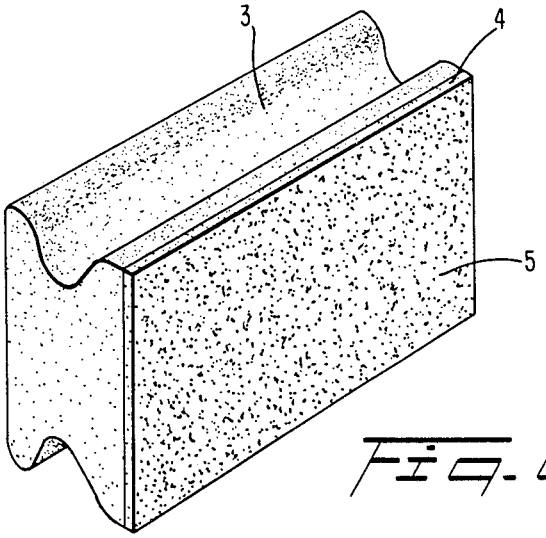
FIG. 2 is a perspective view of a second embodiment of the invention.

The product embodiments of the invention may be seen in FIGS. 1 and 2 accompanying the invention. FIGS. 1 and 2 represent different embodiments of the sponge, pad or other suitable substrate which carries the detergent formulation of this invention in gel form. As will be noted in FIG. 1, the pad comprises a sponge or similar article provided with a plastic wire mesh surface layer 1. In the embodiment shown in FIG. 1, reference numeral 2 represents a sponge of the natural or synthetic type which has the capacity to absorb and hold liquid components. Surface layer 1 is a wire mesh layer of plastic which absorbs the detergent formulation within its interstices and also serves as an abrasive layer for cleaning. The sponge of FIG. 1 is dipped into the liquid detergent formulation at elevated temperatures, the formulation is absorbed throughout the sponge and the plastic layer, and on cooling the formulation forms a gel and is contained therein as a gel.

A second embodiment is shown in FIG. 2 in which reference numeral 3 represents the sponge which can be the same as sponge 2 of FIG. 1. Reference numeral 4 represents the plastic mesh layer and is essentially the same as the layer of reference numeral 1 in FIG. 1. Surface layer 5 is an abrasive layer and designed for cleaning surfaces which require an abrasive material to effect cleaning. In this embodiment, the gelled formulation will be contained primarily in mesh layer 4 with portions also contained in sponge layer 3.

Using either of the embodiments of FIGS. 1 and 2, cleaning is effected by dipping the sponge product containing the gelled layer in water and then abrading the surface to be cleaned with the wet sponge containing the detergent. Alternatively, surfaces to be cleaned can be pre-wetted, and the sponge product can be directly applied to start the cleaning and scrubbing operation. Since the detergent composition has a pH of about 7.5 to 8.5, i.e., about neutral, it is not corrosive and does not injure the user's hands. Use of the product on dirty and grimy surfaces such as whitewall tires provides effective cleaning without damage to the surfaces.

EXAMPLE

A preferred embodiment of the present invention is a composition containing the following components:

| Wt. % | Component |
|---|---|
| 56.49 wt. % | Deionized Water |
| 4.50 | Aqueous 50 wt. % Sodium Hydroxide Solution |
| 3.00 | Potassium Tripolyphosphate |
| 10.00 | Sole Terge TS-2-S (Hodag Chemical Corp.) |
| 15.00 | Stearic Acid, Titer of 52-56° C. |
| 0.50 | Ethylenediaminetetraacetic Acid (technical grade) |
| 10.00 | Triton X-102$^R$ (Rohm and Haas Company) |
| 0.01 | Blue Water Soluble Dye |
| 0.50 | Pine Oil |

In this embodiment the 50 weight percent sodium hydroxide reacts with the stearic acid to form the soap. Potassium tripolyphosphate is used as a filler, as a water softener in combination with ethylenediaminetetraacetic acid (chelating agent), as an alkaline buffer and as a detergent. Sole Terge TS-2-S TM is a sodium 2-ethylhexyl sulfate wetting agent which lifts dirt from the material. Ethylenediaminetetraacetic acid (EDTA) is sued as a chelating agent and also reacts with the sodium hydroxide to provide the sodium form of the EDTA which becomes water soluble. Triton X-102 TM is a polyethoxylated octylphenol surfactant which contains an average of 12-13 ethylene oxide groups. This material is also an emulsifier which enables the composition to be washed out of the material to be treated. Blue water soluble dye is used in this preferred embodiment and pine oil is the odorant.

The combination of compounds in these percentages was found to have a remarkable and surprising effect on the removal of road dirt or grime superior to any composition presently known to exist. Because of its substantially neutral pH (8.0), this composition is effective yet safe.

In forming the product in this preferred embodiment, the sodium hydroxide solution, potassium tripolyphosphate, EDTA, and the Sole Terge TS-2-S are dissolved in the water. The temperature is brought to 160° F. and the stearic acid is slowly added with good agitation. The temperature is raised to 180° F. and, after all the stearic acid is dissolved in the blend, Triton X-102, pine oil and blue dye are added. Plastic mesh pads were then dipped into this hot detergent solution and the solution allowed to gel at ambient or below ambient temperatures.

The prepared pads were then evaluated on the whitewall tires, vinyl tops, and bumpers of automobiles. Very good detergent action and rinsability were obtained.

The invention has been described herein with reference to certain embodiments. However, as obvious variations thereon will become apparent to those skilled in the art, the invention is not considered to be limited thereto.

What is claimed is:

1. A detergent composition having a pH of about 7.5 to 8.5, and comprising, in weight percent:

50-60% water;

2-10% alkali metal hydroxide solution having a concentration of 40-60 weight percent alkali metal hydroxide;

1-10% alkali metal polyphosphate;

5–20% sulfate wetting agent for penetrating a dirt film on a surface to be cleaned;

10–20% fatty acid for reacting on contact with the alkali metal hydroxide to form a soap;

0.1–5% chelating agent for reacting with the alkali metal of the alkali metal hydroxide to form a water soluble derivative; and 5–20% surfactant selected from the group consisting of anionic, nonionic and cationic surface active agents for emulsifying the composition.

2. A composition according to claim 1 wherein the water is deionized water and the alkali metal hydroxide is an aqueous solution of sodium hydroxide or potassium hydroxide.

3. A composition according to claim 1 wherein the alkali metal polyphosphate is a filler, water softener, alkaline buffer and detergent and is selected from the group consisting of tetrasodium pyrophosphate, trisodium pyrophosphate, sodium tripolyphosphate, potassium tripolyphosphate and mixtures thereof.

4. A detergent composition according to claim 1, wherein the sulfate wetting agent comprises sodium 2-ethylhexyl sulfate.

5. A detergent composition according to claim 1, wherein the fatty acid comprises a straight chain fatty acid having 12–20 carbon atoms.

6. A detergent composition according to claim 1, wherein the chelating agent comprises ethylenediaminetetraacetic acid.

7. A detergent composition according to claim 1, wherein the surfactant comprises a nonionic surface active agent having a hydrophobic moiety selected from the group consisting of $C_8$–$C_{20}$ primary and secondary, branch and straight chain monoalcohols, $C_8$–$C_{18}$ mono- and dialkylphenols and $C_8$–$C_{20}$ fatty acid amides, and a hydrophilic moiety comprising alkylene oxide units.

8. A composition according to claim 1 which contains 0.01 to 0.2 weight percent of a water soluble dye or colorant.

9. A composition according to claim 1 wherein the composition contains 0.01 to 1.0 weight percent of an odorant or perfume.

10. The formulation of claim 1 in gel form.

11. A detergent composition having a pH of about 7.5 to 8.5, and comprising, in weight percent:

50–60% water;

2–5% alkali metal hydroxide solution having a concentration of 40–60 weight percent alkali metal hydroxide;

2–5% alkali metal polyphosphate;

8–15% sulfate wetting agent for penetrating a dirt film on a surface to be cleaned;

12–18% fatty acid for reacting on contact with the alkali metal hydroxide to form a soap;

0.2–1.0% chelating agent for reacting with the alkali metal of the alkali metal hydroxide to form a water soluble derivative;

8–15% surfactant selected from the group consisting of anionic, nonionic and cationic surface active agents for emulsifying the composition;

0.01–0.5% water soluble dye or colorant; and 0.01–1.0% odorant or perfume.

12. A detergent formulation having a pH of about 8.0 and comprising the following:

| | |
|---|---|
| 56.49 wt. % | Deionized Water |
| 4.50 | Aqueous 50 wt. % Sodium Hydroxide Solution |
| 3.00 | Potassium Tripolyphosphate |
| 10.00 | [Sole Terge TS-2-S (Hodag Chemical Corp.)] sodium 2-ethylhexyl sulfate |
| 15.00 | Stearic Acid, Titer of 52–56° C. |
| 0.50 | Ethylenediaminetetraacetic Acid [(Any good technical grade can be used)] |
| 10.00 | [Triton X-102 (Rohm and Haas Company)] polyethoxylated octylphenol surfactant |
| 0.01 | Blue Water Soluble Dye |
| 0.50 | Pine Oil |

13. As an article of manufacture a sponge-like substrate containing the following formation in gel form:

50–60% water;

2–10% alkali metal hydroxide solution having a concentration of 40–60 weight percent alkali metal hydroxide;

1–10% alkali metal polyphosphate;

5–20% sulfate wetting agent for penetrating a dirt film on a surface to be cleaned;

10–20% fatty acid for reacting on contact with the alkali metal hydroxide to form a soap;

0.1–5% chelating agent for reacting with the alkali metal of the alkali metal hydroxide to form a water soluble derivative;

5–20% surfactant selected from the group consisting of anionic, nonionic and cationic surface active agents for emulsifying the composition;

0.01–0.5% colorant; and 0.01–1.0% odorant.

14. An article of manufacture according to claim 13 wherein the sponge-like product is a sponge having a plastic wire mesh layer on at least one surface thereof, said detergent formulation being contained primarily within said plastic mesh layer in gel form.

* * * * *